United States Patent [19]

Torrey

[11] 4,234,397

[45] Nov. 18, 1980

[54] NONDESTRUCTIVE METALLOGRAPHIC EXAMINATION OF GAS TURBINE COMPONENTS

[75] Inventor: Charles T. Torrey, Palm Beach Gardens, Fla.

[73] Assignee: United Technologies Corporation, Hartford, Conn.

[21] Appl. No.: 933,945

[22] Filed: Aug. 15, 1978

[51] Int. Cl.[2] ..... C25F 3/02; C25F 5/00

[52] U.S. Cl. ..... 204/129.35; 204/129.85; 204/146

[58] Field of Search ..... 204/146, 129.35, 129.85

[56] References Cited

U.S. PATENT DOCUMENTS

| | | | |
|---|---|---|---|
| 2,706,171 | 4/1955 | Goral et al. | 204/146 |
| 2,840,521 | 6/1958 | Wasserman | 204/146 |
| 3,434,956 | 3/1969 | Glenn | 204/237 |
| 3,779,879 | 12/1973 | Scott | 204/146 |
| 3,788,958 | 1/1974 | Dillenberg | 204/129.85 |

*Primary Examiner*—T. M. Tufariello

*Attorney, Agent, or Firm*—Charles E. Sohl

[57] ABSTRACT

A method is disclosed for the nondestructive examination of coated gas turbine components after service. An electrolytic polishing technique is used to uniformly remove the coating from a portion of the component. An electrolytic etching process is then used to preferentially remove a portion of the underlying substrate so as to leave the microstructure in relief. A metallographic examination may then be made to determine if the part is suitable for reuse. Apparatus for conducting the previously described method is also prevented.

3 Claims, 2 Drawing Figures

CURRENT
a
b
VOLTAGE

13
POWER SOURCE
+
-
11
12
2
1
6
7
10
8
9
3
15
16
5
4
17

NONDESTRUCTIVE METALLOGRAPHIC EXAMINATION OF GAS TURBINE COMPONENTS

BACKGROUND OF THE INVENTION

The invention disclosed herein was made in the performance of or under a contract with the Department of the Air Force.

1. Field of the Invention

This invention relates to the field of examination and refurbishment of gas turbine engine components.

2. Description of the Prior Art

Electrochemical techniques are known for the removal of metal from metal articles. Such techniques are usually used to produce complex surface contours or to remove metal from hard or strong materials which could not otherwise readily be shaped. Typical of this prior art is that shown in U.S. Pat. Nos. 3,095,364 and 3,372,099. Electrolytic techniques are also known for the general production of polished surfaces on metal articles. This is shown in U.S. Pat. No. 3,326,785. It is also known to use electrolytic techniques for the preparation of samples for metallographic examinations. This is shown, for example, in U.S. Pat. Nos. 2,498,220 and 3,434,956. Finally, it is known to use electrolytic techniques for the investigation of the thickness of surface metallic coatings as shown in U.S. Pat. No. 2,319,196.

SUMMARY OF THE INVENTION

Electrolytic polishing is used to uniformly remove the protective surface coating from gas turbine parts, which have been exposed to service conditions, to expose the substrate. An electrolytic etching technique is then used to reveal the characteristics of the underlying substrate by preferentially removing at least a portion of the microstructure. The etched substrate is then examined to determine if the part under investigation is suitable for recoating and reuse in a gas turbine engine. If the part is determined to be satisfactory for reuse, the remainder of the coating may be stripped, and the blade may be recoated with a protective coating and reinstalled in a gas turbine engine for further use.

The foregoing and other objects, features and advantages of the present invention will become more apparent in the light of the following detailed description of preferred embodiments thereof as illustrated in the accompanying drawings.

DESCRIPTION OF THE PREFERRED EMBODIMENTS

As used herein the term "gas turbine engine component" will mean any coated part of a gas turbine engine, which is exposed to elevated temperatures, in particular blades and vanes. Modern gas turbine engines have a limited useful life between overhauls. This is especially true of the high performance engines which may be used in military applications. Overhauls are undertaken either as a matter of routine after a particular length of service has elapsed or as a result of some failure or problem which becomes apparent in service.

Gas turbine engine components are usually fabricated from nickel base superalloys. Representative nickel base superalloys are described in the book entitled "The Superalloys," edited by Simms and Hagel published in 1972 by Wiley Interscience Publications. The metallurgy of such superalloys is now fairly well understood; and for a known superalloy composition, which has had a particular processing history, it is possible to determine by metallographic examination the maximum service temperature to which the superalloy has been exposed. In particular, when an alloy is exposed to a higher than intended service temperature, changes in the size and distribution of the gamma phase will become apparent. For exposures only slightly in excess of the temperature capability of the alloy the effect on the microstructure will usually be a coarsening or enlargement of the gamma phase particles. Exposure to somewhat greater temperatures may produce dissolution of the second phase; and finally, exposure at temperatures much in excess of the capability of the alloy may result in localized melting. It is, therefore, possible for one skilled in the art to examine a superalloy component, which has been exposed to an elevated temperature, and formulate an accurate estimate of the temperature conditions to which the alloy has been exposed and to estimate the future life of the component at a particular temperature before failure occurs. Heretofore, such metallographic examinations have been destructive examinations requiring that one or more of the used components from an engine be sectioned or cut into pieces for examinations. This procedure has the obvious drawback of sacrificing one or more of the components for examination and of limiting the possibility for general examination of all components. Such a procedure might be satisfactory in accessing the potential life remaining in engine components from an engine which was undergoing a routine overhaul. However, if localized overheating were suspected, it would be difficult to be certain that the component examined was representative of the overheated components. Thus, it is an object of this invention to provide an examination technique which will provide for the nondestructive examination of gas turbine engine components and will permit the examination of any or all of the components in an engine.

Figure 1:
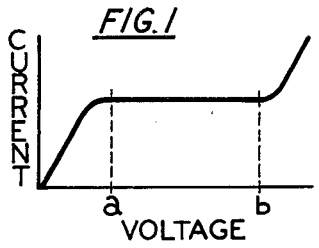
FIG. 1 shows the relationship between voltage and current in a typical electrolytic polishing/etching situation.

In electropolishing and electroetching techniques, the surface to be polished or etched is placed in a suitable electrolyte and is made an anode with respect to a nonreactive cathode, which is immersed in the same electrolyte. A voltage is then applied between the anode and cathode causing current to flow and resulting in the removal of material from the anode. FIG. 1 shows a schematic of the behavior which may usually be obtained for a particular combination of anode electrolyte and temperature conditions. This is a desired behavior. The curve in FIG. 1 is seen to consist of two sloping portions connected by a relatively flat portion which is termed a "plateau." Etching or the preferential removal of one phase of the material producing a roughened or etched surface will be observed for operating conditions in the two sloping portions of the curve. Voltage conditions between points A and B, the plateau portion of the curve, will produce electropolishing or the smooth uniform removal of material from the surface.

The present invention requires that an electrolyte and other conditions be provided which produce this type of behavior as a function of the voltage. While specific electrolytes will be described, this invention does not lie in the specific electrolyte, but is generally applicable and useful in conjunction with many electrolytes which produce the type of behavior shown in FIG. 1. Briefly, the invention process consists of providing the used gas turbine engine component to be evaluated, mechanically removing any insulating oxide which may be present on the surface, electropolishing the surface of the component to provide the smooth uniform removal of the protective coating; and finally, electroetching the substrate of the article to reveal its microstructural characteristics.

Figure 2:
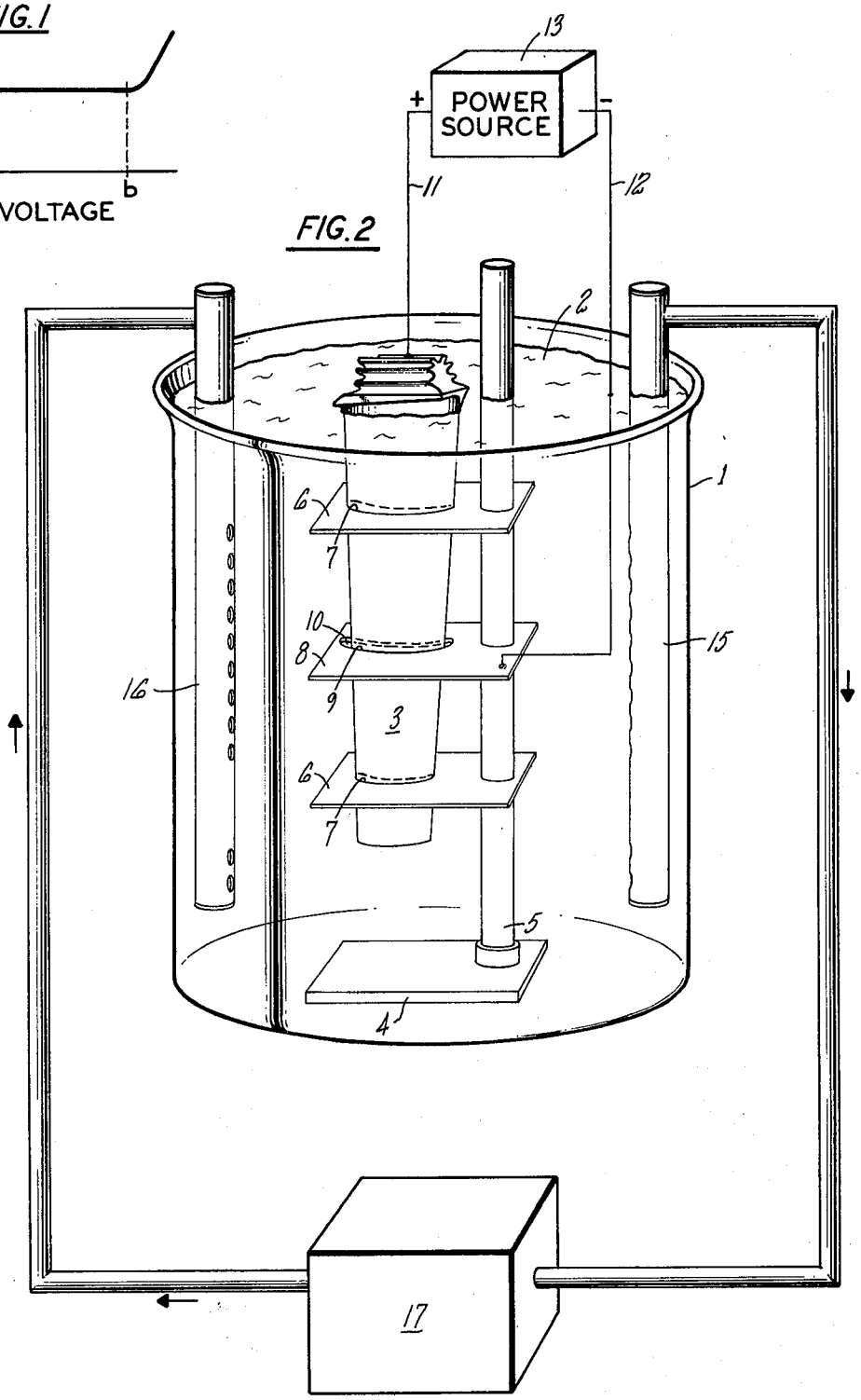
FIG. 2 shows one type of apparatus which may be used to practice the process or the invention.

The method of the invention will be better understood through reference to FIG. 2, which shows an apparatus for performing the invention. FIG. 2 shows a container 1, which contains the electrolyte solution 2, and in which the component 3 to be examined is supported so that the portion to be examined is immersed in the electrolyte. The component 3 is shown as a gas turbine blade. In FIG. 2, there is shown a base element 4, which supports a vertical support member 5 which in turn, has attached to it, shaped insulating members 6 having cutouts 7, which closely conform to the cross section of the blade to be examined. These insulating members 6 and associated cutouts 7 serve to accurately locate the component.

The particular method of supporting and locating the component within the electrolyte is not critical to the invention. Support means could be supplied external to this solution or only one insulator within the solution might be used in conjunction with an external support arrangement. In FIG. 2, there is shown a sheet metal cathode 8 having a cutout 9 therein which is uniformly larger than the cross section of the blade. Thus, when the blade is properly located within this cutout, there exists a substantially uniform annular space 10 between the cathode 8 and blade 3. Conductive means 11 and 12 serve to connect the cathode 8 and blade 3 with a conventional power supply 13, which is arranged so that the blade is positive with respect to the cathode. Also shown in FIG. 2 is a means for circulating the electrolyte so as to provide for the removal of the products of the electrolytic reaction which removes material from the blade 3 in the area near the cathode 8. In FIG. 2, this electrolyte circulation means is shown as an inlet pipe 15 and a pickup pipe 16 each having a series of distribution holes therein which are connected to a circulating pump 17 which in turn is powered by a suitable motor. This pump serves to provide the electrolyte under pressure to the inlet tube 15 and remove electrolyte through the outlet tube 16. The pump 17 may be of standard construction and may have associated with it suitable filtration means for removing any solid products of the electrolytic reaction. The means used to circulate the electrolyte is not critical, magnetic stirring means have been used in laboratory evaluations.

The effect of the apparatus shown in FIG. 2 is to remove the coating from the blade in the uniform band around the blade, with the band being located in close proximity to the cathode. The position of the band may be varied so to provide assessments of the condition of the microstructure at different portions of the blade. The conditions of the microstructure at the leading edge of the blade is of particular interest, since this is generally the portion of the blade which sees the highest service temperature.

As previously noted, the process employs two electrolytic steps. In the first step, electrolytic polishing is used to uniformly remove the protective coating. In the second step, electrolytic etching is employed to produce a very fine roughening of the surface of the underlying substrate to permit metallographic examination. The change from electrolytical polishing to electrolytic etching is achieved by a change in the applied voltage from the power supply. Once the pre-existing protective coating has been removed by electropolishing and the underlying substrate has been roughened by electroetching the part is removed from the solution, rinsed to remove any traces of electrolyte, and is then examined. Examination may be by either optical microscopy or electron microscopy. If optical microscopy is employed, the surface of the blade may be directly examined under an appropriate microscope. If electron microscopy is to be employed, it is necessary to produce a replica of the surface of the article. This replication process may be any one of several well known techniques. A typical replication process employs a plastic film which is softened in a solvent and then applied to the surface to be examined so that the softened plastic adapts to the exact contours of the surface to be examined. The softened film is allowed to dry by evaporation of the solvent and is then removed. The film after removal maintains the surface contour and may be shadowed with metal vapor in preparation for observation in an electron microscope. Sample preparation techniques for surface replication are described in numerous books on electron microscopy. In particular in the book entitled "Manual of Electron Metallography" published in 1973 by The American Society for Testing And Materials. Replicas produced by these methods may also be evaluated by optical microscopy and such replicas may be stored for future reference.

The previously described process may be better understood through reference to the following illustrative example. Cast gas turbine engine components consisting of an alloy known as Mar M200+$H_f$ *having a nominal composition of* 9 Cr, 10 Co, 12 W, 1 Cb, 2 Ti, 5 Al, 2 $H_f$, 0.015 B, 0.15 C, which are coated with a protective diffused aluminum-silicon coating known as PWA 47 having a composition of about 90% Al, 10% Si are removed from a gas turbine engine. It is desired to determine if these blades may be recoated and reinstalled in the engine. A solution consisting of 94% acetic acid and 6% perchloric acid is employed as an electrolyte. An electrode is provided which surrounds the blade and is separated from the blade by about 0.030 inches of electrolyte. This electrode is formed from stainless steel. A voltage of 45 volts is employed which produces a current density of about 0.5 amps per square centimeter of blade area. A polishing cycle lasts for about 30 seconds at which time pre-existing protective coating (PWA 47) is found to be completely removed from the blade in the area adjacent to the electrode. The voltage is then reduced to about 4 volts which produces a current density of about 0.03 amps per square centimeter for etching. Etching continues for about 10 to 15 seconds to produce a surface condition suitable for metallographic examinations. A plastic replica is made of the etched surface and is examined. Examination by one skilled in the art will readily reveal if the balde has been exposed to excessive temperatures and will indicate if the blade is suitable for reuse. If the blade is suitable for reuse, the entire protective coating may be chemically stripped from the blade using any one of several well known solutions. The blade may then be cleaned by shot peening and then recoated with the same or another protective coating and reinstalled in the engine.

An alternate solution which may be employed is one consisting of about 13% concentrated sulfuric acid, balance methanol. The process of the invention has been used to remove PWA 47 coating (a diffused aluminum-silicon coating produced by vapor deposition) from IN100 engine components having a nominal composition of 9.5 Cr, 15 Co, 3 Mo, 4.8 Ti, 5.5 Al, 0.95 V, 0.17 C, 0.006 Zr, 0.015 B, balance Ni.

Although this invention has been shown and described with respect to a preferred embodiment thereof, it should be understood by those skilled in the art that various changes and mossions in the form and detail thereof may be made therein without departing from the spirit and scope of the invention.

Having thus described a typical embodiment of our invention, that which we claim as new and desire to secure by Letters Patent of the United States is:

1. A nondestructive method for examining gas turbine engine components, of the type having a superalloy substrate and a protective aluminide coating thereon, after service including the steps of:

a. mechanically abrading the blade surface to remove any oxide coating;

b. immersing the blade in an electrolytic solution in which an electrode is also immersed;

c. applying a voltage between the blade and the electrode, through the electrolytic solution, so that the blade is positive respect to the electrode;

d. regulating the voltage to cause electropolishing of the component until the aluminide coating is essentially removed to expose the substrate;

e. changing the voltage by means external to the electrolyte-blade-electrode combination, to cause electroetching of the underlying substrate;

f. examining the etched substrate, by optical or electron microscopy techniques to determine the metallographic structure and gamma prime morphology so as to determine the condition of the substrate and its suitability for further use.

2. A method as in claim 1 wherein the electrolytic solution contains acetic acid and perchloric acid.

3. A method as in claim 1 wherein the electrolytic solution contains sulfuric acid and methanol.

* * * * *